US005381323A

United States Patent [19]

Osteen et al.

[11] Patent Number: 5,381,323

[45] Date of Patent: Jan. 10, 1995

[54] SENSOR HOUSING AND ADJUSTABLE MAST ARM FOR A SWIVEL LIGHTING FIXTURE

[75] Inventors: Mitchell M. Osteen, Zirconia; Suleyman O. Sumer, Chapel Hill; Charles L. Dozier, Camden; Santiago Singarayar, Burlington, all of N.C.

[73] Assignee: Regent Lighting Corporation, Burlington, N.C.

[21] Appl. No.: 130,280

[22] Filed: Oct. 1, 1993

[51] Int. Cl.[6] ..... F21S 1/14

[52] U.S. Cl. ..... 362/276; 362/394; 362/419; 362/421; 362/802; 362/294; 340/567

[58] Field of Search ..... 362/160, 421, 145, 276, 362/802, 250, 251, 432, 413; 340/567, 573; 250/555, 556, 552, 553, 554, 342

[56] References Cited

U.S. PATENT DOCUMENTS

| | | | |
|---|---|---|---|
| 1,473,400 | 11/1923 | Dunn | 362/267 |
| 1,584,369 | 5/1926 | Graham | 362/362 |
| 1,783,516 | 12/1930 | Moreton | 362/421 |
| 3,278,203 | 8/1966 | Snyder | 285/160 |
| 4,044,251 | 8/1977 | Taylor | 250/342 X |
| 4,333,132 | 10/1982 | Paley | 362/421 |
| 4,768,020 | 8/1988 | Chen | 340/567 |
| 5,086,379 | 7/1992 | Denison et al. | 362/145 |
| 5,176,443 | 1/1993 | Lin | 362/413 |
| 5,258,899 | 11/1993 | Chen | 362/421 X |

*Primary Examiner*—Ira S. Lazarus
*Assistant Examiner*—Thomas M. Sember
*Attorney, Agent, or Firm*—Rhodes, Coats & Bennett

[57] ABSTRACT

A lighting fixture having a new and improved sensor housing and an adjustable mast arm. The sensor housing includes a top wall, a bottom wall, a back wall having a first lead aperture for establishing electrical and mechanical connections between a proximity sensor and a source of electrical power, a transition wall, a pair of side walls, and at least one drain aperture located between the transition wall and the bottom wall. A first partition wall is located between the bottom wall and the transition wall. The first partition wall extends between the pair of side walls to form a cavity including at least one drain aperture for preventing the accumulation of water in the sensor housing. An adjustable mast arm is connected between the base and the sensor housing. The adjustable mast arm includes a first pivot joint attached between the base and one end of the arm, a second pivot joint attached between the sensor housing and the other end of the arm, and a swivel joint located between the first and second pivot joints.

25 Claims, 2 Drawing Sheets

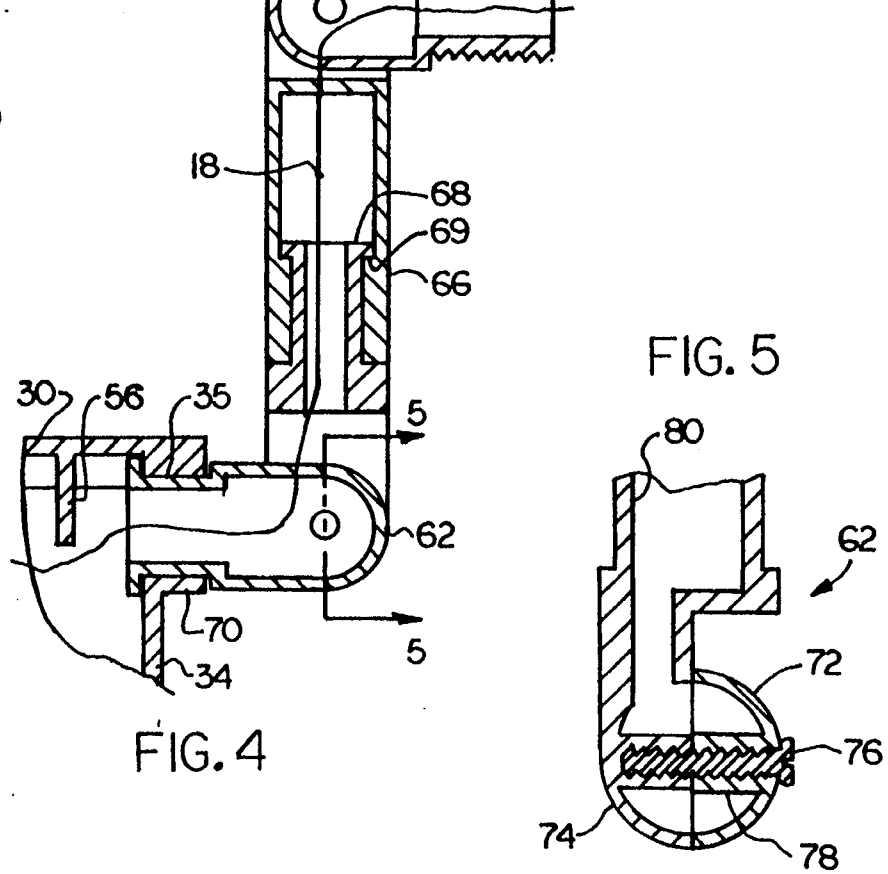
FIG. 5
FIG. 4
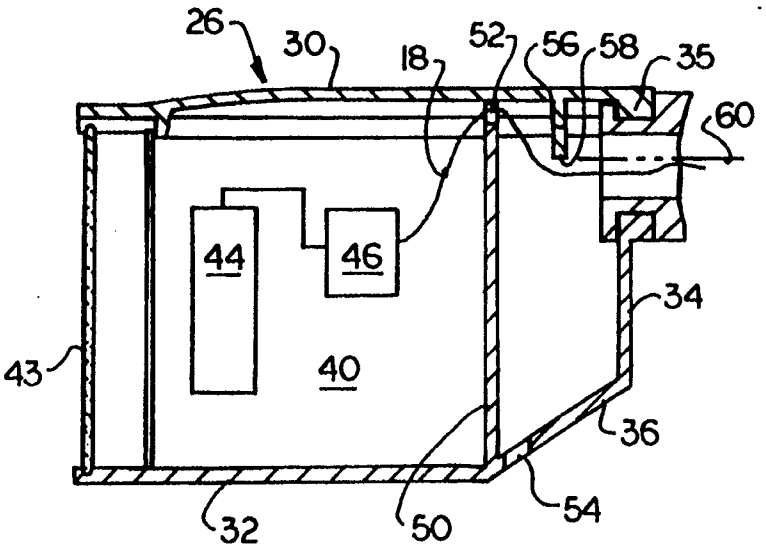
FIG. 3

SENSOR HOUSING AND ADJUSTABLE MAST ARM FOR A SWIVEL LIGHTING FIXTURE

BACKGROUND OF THE INVENTION

1. Field of the Invention

The present invention relates generally to lighting fixtures and, more particularly, to a new and improved proximity sensor housing and an adjustable mast arm for an outdoor lighting fixture for mounting a pair of flood lights or the like.

2. Description of the Prior Art

Outdoor flood lights have been known for many years. In such devices, it is common to provide a mechanism in the mounting whereby the direction of the light may be adjusted at least to a limited degree. A common manner in which this is accomplished is by providing a connection between the fight fixture and the base by which the fixture may be moved relative to the base and then secured against further motion.

U.S. Pat. No. 4,333,132, issued to Paley, discloses a manually controlled, environmentally sealed swivel unit for use in an adjustable lighting fixture. The swivel unit comprises a base, a housing, a swivel ball device and a means for controlling the rotation of the swivel ball. This arrangement allows the swivel ball to rotate about a first axis and also to rotate about the second axis perpendicular to the first axis. The swivel unit further includes a tension means for forcing the swivel ball controller against the swivel ball device to define a predetermined lamp holding force.

The Denison patent (U.S. Pat. No. 5,086,379) and the Snyder patent (U.S. Pat. No. 3,278,203) disclose two additional examples of swivel or ball-and-socket type joints used in lighting fixtures.

However today, many lighting fixtures also include a proximity sensor which is operable to actuate the light for variable or fixed amounts of time when an object is detected in the path of the sensor. Certain problems have been encountered in incorporating a successful proximity sensor-into flood lights. One problem is that the sensor housing must be movable over a wide number of positions in order to focus on a selected area of interest. Another problem is that the sensor must be off-set from the lamps in order to avoid heat build-up from the lamps which will cause the sensor to fail prematurely. A final problem is that the sensor housing must either be water tight or allow water to escape from the housing in order to protect the electronics associated with the sensor.

Various solutions have been tried to overcome these problems. In one early approach, the sensor housing was off-set from the lighting fixture base by a length of tubing having ball-and-socket joints located at each of its ends. This approach does off-set the housing from the heat of the lights. However, the ball-and-socket joints are limited to about a 60°–90° field of rotation. Accordingly, this design limits the positioning of the sensor. In addition, the path through the ball-and-socket for the electrical leads to power the sensor is a natural conduit for water to enter the housing and damage the electronics in the housing.

Another approach which has been moderately successful is an inverted L-shaped bracket attached to the base of the lighting fixture and downwardly extending to off-set the sensor from the area around the heat of the lights. The inverted L-shaped bracket includes a horizontal swivel portion located midway along the bracket and a 180° pivotable joint located at the end of the bracket opposite the end attached to the base. Such an arrangement does avoid the heat of the lights but provides only limited positioning along two axes for positioning the sensor. In addition, the L-shaped bracket still provides a path for water to enter the sensor housing, thereby possibly damaging the electronics housed therein.

Thus, there remained a need for a new and improved sensor housing having an adjustable mast arm for a swivel lighting fixture which is operable to position the sensor housing away from the heat of the lamps and provide a high degree of flexibility for positioning the sensor while, at the same time, eliminating the danger of water entering and damaging the electronics enclosed in the sensor housing.

SUMMARY OF THE INVENTION

The present invention is directed to a lighting fixture having a new and improved sensor housing and an adjustable mast arm. The fixture includes a lampholder for receiving a floodlight or the like, a base for establishing electrical and mechanical connections with a source of electrical power, and means connected between the base and the end of the lampholder for supporting the lampholder and permitting the lampholder to be manually positioned with respect to the base. The fixture further includes a sensor housing for enclosing a proximity sensor for controlling the floodlights. The sensor housing includes a top wall, a bottom wall, a back wall having a first lead aperture for establishing electrical and mechanical connections between the proximity sensor and the source of electrical power, a transition wall, a pair of side walls, and at least one drain aperture located between the transition wall and the bottom wall. A first partition wall is located between the bottom wall and the transition wall. The first partition wall extends between the pair of side walls to form a cavity including at least one drain aperture for preventing the accumulation of water in the sensor housing. In the preferred embodiment, a second partition wall is located between the first partition wall and the back wall. The second partition wall is attached to the top wall and extends substantially parallel to the first partition wall and the back wall for preventing water from leaving the cavity formed between the first partition wall and the back wall along the electrical leads connecting the proximity sensor to the source of electrical power.

An adjustable mast arm is connected between the base and the sensor housing. The adjustable mast an includes a first pivot joint attached between the base and one end of the arm, a second pivot joint attached between the sensor housing and the other end of the arm, and a swivel joint located between the first and second pivot joints. In the preferred embodiment, the arm also includes a second swivel joint located between the sensor housing and the second pivot joint.

Accordingly, one aspect of the present invention is to provide a lighting fixture. The fixture includes: (a) a lampholder for receiving a floodlight or the like; (b) a base for establishing electrical and mechanical connections with a source of electrical power, the base having an aperture for receiving one end of the lampholder; (c) means connected between the base and the end of the lampholder for supporting the lampholder and permitting the lampholder to be manually positioned with respect to the base; (d) a sensor housing for enclosing a proximity sensor for controlling the floodlights, the sensor housing having a top wall, a bottom wall, a back wall having a first lead aperture for establishing electrical and mechanical connections between the proximity sensor and the source of electrical power, a transition wall, a pair of side walls, and at least one drain aperture located between the transition wall and the bottom wall; and (e) an adjustable mast unconnected between the base and the sensor housing.

Another aspect of the present invention is to provide a lighting fixture. The fixture includes: (a) a lampholder for receiving a floodlight or the like; (b) a base for establishing electrical and mechanical connections with a source of electrical power, the base having an aperture for receiving one end of the lampholder; (c) means connected between the base and the end of the lampholder for supporting the lampholder and permitting the lampholder to be manually positioned with respect to the base; (d) a sensor housing for enclosing a proximity sensor for controlling the floodlights, the sensor housing having a top wall, a bottom wall, a back wall, and a pair of side walls; and (e) an adjustable mast arm connected between the base and the sensor housing, the adjustable mast arm including a first pivot joint attached between the base and one end of the arm, a second pivot joint attached between the sensor housing and the other end of the arm, and a swivel joint located between the first and second pivot joints.

Still another aspect of the present invention is to provide a lighting fixture. The fixture includes: (a) a lampholder for receiving a floodlight or the like; (b) a base for establishing electrical and mechanical connections with a source of electrical power, the base having an aperture for receiving one end of the lampholder; (c) means connected between the base and the end of the lampholder for supporting the lampholder and permitting the lampholder to be manually positioned with respect to the base; (d) a sensor housing for enclosing a proximity sensor for controlling the floodlights, the sensor housing having a top wall, a bottom wall, a back wall having a first lead aperture for establishing electrical and mechanical connections between the proximity sensor and the source of electrical power, a transition wall, a pair of side walls, and at least one drain aperture located between the transition wall and the bottom wall; and (e) an adjustable mast arm connected between the base and the sensor housing, the adjustable mast arm including a first pivot joint attached between the base and one end of the arm, a second pivot joint attached between the sensor housing and the other end of the arm, and a swivel joint located between the first and second pivot joints.

These and other aspects of the present invention will become apparent to those skilled in the art after a reading of the following description of the preferred embodiment when considered with the drawings.

BRIEF DESCRIPTION OF THE DRAWINGS

FIG. 3 is an enlarged, partial cross-sectional view of the sensor housing shown in FIG. 1, taken along line 3—3;

FIG. 4 is an enlarged, partial cross-sectional view of the adjustable mast arm shown in FIG. 1, taken along line 4—4; and FIG. 5 is an enlarged, partial cross-sectional view of the lower pivot joint of the adjustable mast arm shown in FIG. 4, taken along line 5—5.

DESCRIPTION OF THE PREFERRED EMBODIMENTS

Figure 2:
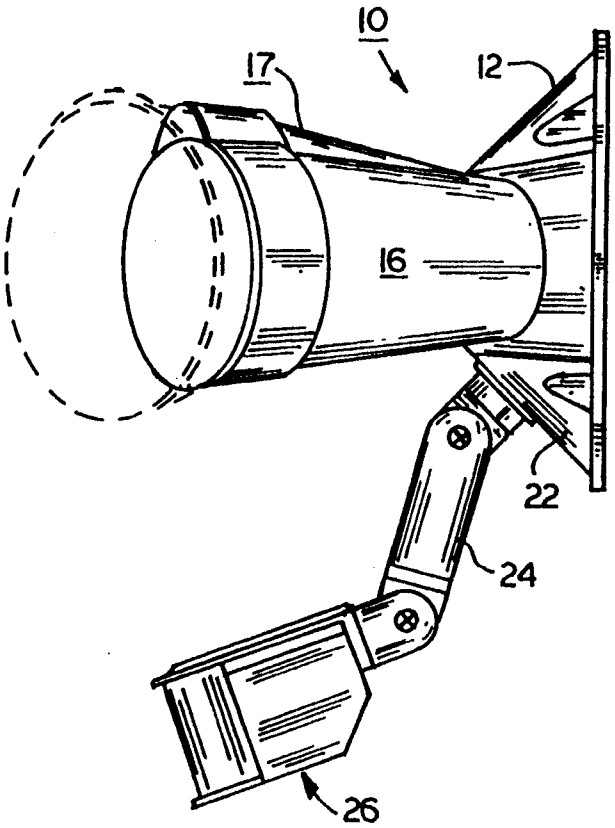
FIG. 2 is a side view of the lighting fixture shown in FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
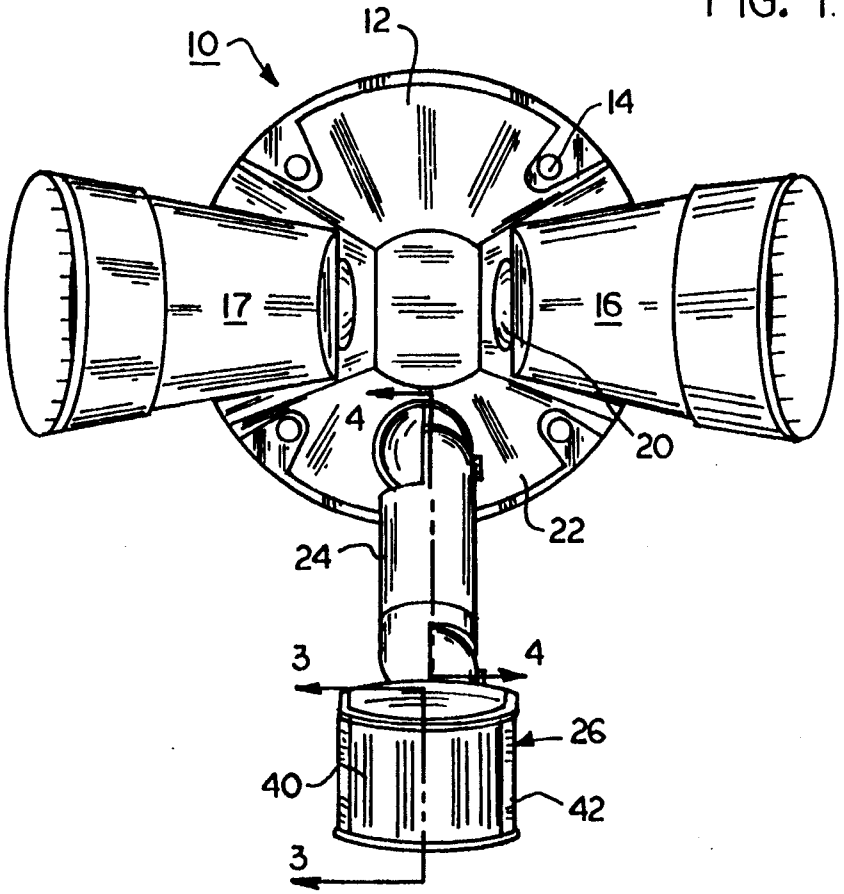
FIG. 1 is a front view of a swivel lighting fixture including an adjustable mast arm and sensor housing constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, a swivel lighting fixture, generally designated 10, is shown constructed according to the present invention. The lighting fixture 10 includes: a base 12; lamp holders 16, 17; and a ball-and-socket assembly 20.

Base 12 is preferable a truncated polygon having a plurality of recessed apertures 14 located about its periphery for receiving conventional fasteners. Preferably, the sides of the base form an included angle of about 50°. Lamp holders 16, 17 each include electrical leads 18 (see FIGS. 3 and 4) which pass through ball-and-socket assembly 20 to provide an electrical connection for each lamp holder. The lower wall 22 of base 12 is adapted for receiving an adjustable mast arm, generally designated 24, constructed according to the present invention. At the end of the adjustable mast are is a proximity sensor housing, generally designated 26, also constructed according to the present invention, Turning now to FIG. 2, there is shown a side view of the lighting fixture shown in FIG. 1. As can be seen, adjustable mast arm 24 positions the sensor housing 26 away from the heat of the lamps located in lamp holders 16 and 17. In addition, adjustable mast arm 24 is articulated to permit sensor housing 26 to be moved over a variety of positions, thereby adjusting the field of view by the proximity sensor.

As best seen in FIG. 3, there is shown an enlarged, partial cross-sectional view of the sensor housing shown in FIG. 1, taken along line 3—3. Sensor housing 26 includes a top wall 30, a bottom wall 32, and a back wall 34 having an aperture 35 for receiving the electrical leads 18. A sloped transition wall 36 is connected between back wall 34 and bottom wall 32. Side walls 40, 42 complete the assembly.

The front portion of the sensor housing 26 is generally open to permit an unobscured field for an infrared sensor 44. In the preferred embodiment, a refracting lens 43 made from semi-transparent polyethylene covers the front portion to keep out the elements. Sensor 44 is connected to a circuit board 46 and the plurality of electrical leads extend from circuit board 46 through the adjustable mast arm to the base of lighting fixture 10.

According to the present invention, a first partition wall 50 is mounted adjacent to the lower edge of transition wall 36 and attached to bottom wall 32 and side walls 40, 42. Electrical lead apertures 52 permit the electrical leads 18 to pass between top wall 30 and the upper edge of first partition wall 50. At least one drain aperture 54 is located in transition wall 36 adjacent to the first partition wall 50 to permit water entering the housing 26 to escape.

In the preferred embodiment, a second partition wall 6 is attached to the top wall 30 extends below the center line of aperture 35 to force electrical leads 18 to wrap around the bottom edge of the second partition wall 56, thereby causing any moisture entering the housing by means of electrical leads 18 to drip into the chamber formed by first partition wall 50 and back wall 34.

The present invention is based, in part, on the discovery that there isn't any need to try to make the housing 26 a sealed unit as long as there is a provision for any water which is trapped into it to readily escape, rather than form a pool of water. It is permissible by Underwriters Laboratories (UL) and also an acceptable practice from a quality view point to allow water to contact the thermoplastic insulated lead wires as long as the wires do not stand in a pool of water for a long period of time. It is also advantageous to let the water out, since often times the source of water in the prior art arms is by entry by way of the customer's wiring box over which the manufacturer of the lighting fixture has no control.

The normal practice would simply to have drain holes in the housing. However, it is not acceptable to have water on the electronic components on the circuit boards for even a short period of time. The combination of a partition wall between the portion of the housing containing the electronics and the entry port for the electrical hook-up wires and drain holes in this cavity prevents water from simply running down the leads into the housing containing the electronics and the circuit boards.

The partition wall forming a cavity and having drain holes works well in most positions. However, in some positions, water could still run along the wires through the first chamber into the second cavity containing the electronics. However, the short wall 56 coming off the top of the first cavity intentionally pushes the leads down into the cavity far enough so that in all aiming positions the water would have to run uphill in order to get into the electronics cavity. Thus, the combination of the first and second partition walls solves the water entry problem related to lead wires and the mounting arrangements without having to hermetically seal the housing, mounting arm and customer wiring box.

Turning now to FIG. 4, there is shown an enlarged partial cross-sectional view of the adjustable mast arm shown in FIG. 1, taken along line 4—4. As can be seen, the adjustable mast arm of the present invention includes a number of articulated joints which allows the arm to be off-set from the heat of the flood lamps while, at the same time, permits the sensor housing to be positioned as needed.

A first 180° pivot joint 62 is attached at one end of the adjustable mast arm adjacent to the sensor housing. A second 180° pivot arm is attached at the other end of the adjustable mast arm, at the end of the arm adjacent to base 12. A first 360° swivel joint 66 is located between the first and second 180° pivot joints. The first 360° swivel joint 66 is formed by the mating of a pair of complementary shoulders 68, 69. In the preferred embodiment, the adjustable mast arm also includes a second 360° swivel joint 70 which permits the sensor housing 26 to be rotated between vertical and horizontal orientations. This arrangement permits the sensor housing 26 to move along three axes of rotation.

Finally, turning to FIG. 5, there is shown an enlarged, partial cross-sectional view of the lower 180° pivot joint of the adjustable mast arm shown in FIG. 4, taken along line 5—5. The upper pivot joint 64 is essentially similar to the lower pivot joint 62. Lower first 180° pivot joint 62 preferably includes a first hemispherical mating half 72 and a second hemispherical mating half 74 attached together by means of a threaded fastener 76. A pivot post 78 located in the first hemispherical mating half 72 has an inner diameter slightly greater than the outer diameter of the fastener to permit the two halves of the hemisphere to rotate together without binding. A channel 80 extends through the hemispheres permit the electrical leads 18 to pass from the electronics in the sensor housing to the base of lighting fixture 10.

Certain modifications and improvements will occur to those skilled in the art upon a reading of the foregoing description. By way of example, the arm and housing of the present invention could be used alone to remotely actuate a separate lighting fixture. Also, a single light could be used instead of a pair of swivel lights. It should be understood that all such modifications and improvements have been deleted herein for the sake of conciseness and readability but are properly within the scope of the following claims.

We claim:

1. A lighting fixture, said fixture comprising:

(a) a lampholder for receiving at least one floodlight or the like;

(b) a base for establishing electrical and mechanical connections with a source of electrical power, said base having an aperture for receiving one end of said lampholder;

(c) means connected between said base and the end of said lampholder for supporting said lampholder and permitting said lampholder to be manually positioned with respect to said base;

(d) a sensor housing for enclosing a proximity sensor for controlling said floodlight, said sensor housing having a top wall, a bottom wall, a back wall having a first lead aperture for establishing electrical and mechanical connections between said proximity sensor and said source of electrical power, a transition wall, a pair of side walls, and at least one drain aperture located between said transition wall and said bottom wall, said sensor housing further including a first partition wall located between said bottom wall and said transition wall, said first partition wall extending between said pair of side walls to form a cavity, said cavity including said at least one drain aperture, wherein said first partition wall extends substantially from said bottom wall to said top wall and further including a second partition wall located between said first partition wall and said back wall, said second partition wall attached to said top wall and extending substantially parallel to said first partition wall and said back wall; and (e) an adjustable mast arm connected between said base and said sensor housing.

2. The fixture according to claim 1, wherein said lampholder is a tubular shaped member having an open end for receiving the base of said floodlight.

3. The fixture according to claim 2, further including an electrical lamp socket mounted in said lampholder for receiving the base of said floodlight.

4. The fixture according to claim 1, wherein said base includes means for mounting said base to a flat surface.

5. The fixture according to claim 4, wherein said means for mounting said base to a flat surface includes a plurality of recessed apertures located along the periphery of said base for receiving a plurality of threaded fasteners for engaging said flat surface.

6. The fixture according to claim 1, wherein said base is a truncated polygon.

7. The fixture according to claim 6, wherein said base is substantially a truncated pyramid.

8. The fixture according to claim 7, wherein said truncated pyramid includes two opposed sides forming an included angle of about 50 degrees.

9. The fixture according to claim 8, wherein said truncated pyramid includes two opposed sides forming an arcuate surface.

10. The fixture according to claim 9, wherein said adjustable mast arm is attached at one end to one of said opposed sides forming an arcuate surface.

11. The fixture according to claim 1, wherein said first partition wall includes at least one second lead aperture adjacent to said top wall for establishing electrical and mechanical connections between said proximity sensor and said source of electrical power. substantially parallel to said first partition wall and said back wall.

12. The fixture according to claim 1, wherein said second partition wall located between said first partition wall and said back wall extends to approximately the centerline of said first lead aperture.

13. A lighting fixture, said fixture comprising:

(a) a lampholder for receiving at least one floodlight or the like;

(b) a base for establishing electrical and mechanical connections with a source of electrical power, said base having an aperture for receiving one end of said lampholder;

(c) means connected between said base and the end of said lampholder for supporting said lampholder and permitting said lampholder to be manually positioned with respect to said base;

(d) a sensor housing for enclosing a proximity sensor for controlling said floodlight, said sensor housing having a top wall, a bottom wall, a back wall having a first lead aperture for establishing electrical and mechanical connections between said proximity sensor and said source of electrical power, a transition wall, a pair of side walls, and at least one drain aperture located between said transition wall and said bottom wall, said sensor housing further including a first partition wall located between said bottom wall and said transition wall, said first partition wall extending between said pair of side walls to form a cavity, said cavity including said at least one drain aperture, wherein said first partition wall extends substantially from said bottom wall to said top wall and further including a second partition wall located between said first partition wall and said back wall, said second partition wall attached to said top wall and extending substantially parallel to said first partition wall and said back wall; and (e) an adjustable mast arm connected between said base and said sensor housing, said adjustable mast arm including a first pivot joint attached between said base and one end of said arm, a second pivot joint attached between said sensor housing and said other end of said arm, and a swivel joint located between said first and second pivot joints.

14. The fixture according to claim 13, wherein said lampholder is a tubular shaped member having an open end for receiving the base of said floodlight.

15. The fixture according to claim 14, further including an electrical lamp socket mounted in said lampholder for receiving the base of said floodlight.

16. The fixture according to claim 13, wherein said base includes means for mounting said base to a flat surface.

17. The fixture according to claim 16, wherein said means for mounting said base to a flat surface includes a plurality of recessed apertures located along the periphery of said base for receiving a plurality of threaded fasteners for engaging said flat surface.

18. The fixture according to claim 13, wherein said base is a truncated polygon.

19. The fixture according to claim 18, wherein said base is substantially a truncated pyramid.

20. The fixture according to claim 19, wherein said truncated pyramid includes two opposed sides forming an included angle of about 50 degrees.

21. The fixture according to claim 20, wherein said truncated pyramid includes two opposed sides forming an arcuate surface.

22. The fixture according to claim 21, wherein said adjustable mast arm is attached at one end to one of said opposed sides forming an arcuate surface.

23. The fixture according to claim 13, wherein said first partition wall includes at least one second lead aperture adjacent to said top wall for establishing electrical and mechanical connections between said proximity sensor and said source of electrical power.

24. The fixture according to claim 18, wherein said second partition wall located between said first partition wall and said back wall extends to approximately the centerline of said first lead aperture.

25. The fixture according to claim 13, further including a second swivel joint located between said sensor housing and said second pivot joint.

* * * * *